US005410386A

United States Patent [19]

Swift et al.

[11] Patent Number: 5,410,386

[45] Date of Patent: Apr. 25, 1995

[54] HOLLOW PULTRUDED ELECTICAL CONTACT

[75] Inventors: Joseph A. Swift, Ontario; Stanley J. Wallace, Victor; John E. Courtney, Macedon; Wilbur M. Peck, Rochester; Thomas E. Orlowski, Fairport, all of N.Y.

[73] Assignee: Xerox Corporation, Stamford, Conn.

[21] Appl. No.: 84,720

[22] Filed: Jun. 25, 1993

[51] Int. Cl.[6] ..... G03G 15/00

[52] U.S. Cl. ..... 355/200; 355/219; 361/221; 428/294

[58] Field of Search ..... 361/212, 220–222; 355/200, 210, 219, 224; 428/294, 295

[56] References Cited

U.S. PATENT DOCUMENTS 4,206,958 6/1980 Hall et al. .
4,336,565 6/1982 Murray et al. .
4,358,699 11/1982 Wilsdorf .
4,741,873 5/1988 Fischer et al. .
4,761,709 8/1988 Ewing et al. .
4,801,967 1/1989 Snelling .
4,945,342 7/1990 Steinemann .
5,010,441 4/1991 Fox et al. .
5,139,862 8/1992 Swift et al. ..... 428/294
5,177,529 1/1993 Schroll et al. .
5,270,106 12/1993 Orlowski et al. ..... 355/219 X
5,354,607 10/1994 Swift et al. ..... 428/294

*Primary Examiner*—R. L. Moses

[57] ABSTRACT

An electroconductive contact is formed of a pultruded member that has a hollow construction. The pultruded member includes a plurality of continuous electroconductive strands embedded in a resin material. At least one end of the pultruded member has laser fibrillated strands that are intended to contact a photoreceptive belt. An alignment structure can be integrally formed during the pultrusion process on a surface of the pultruded member. The alignment structure aligns the pultruded member relative to a contact. The electroconductive contact may also provide electrical connection between a photoreceptive belt and a ground terminal.

41 Claims, 3 Drawing Sheets

HOLLOW PULTRUDED ELECTICAL CONTACT

FIELD OF THE INVENTION

This invention relates to electrical contacts and more particularly to pultruded electroconductive contacts, and to methods for making the same.

BACKGROUND OF THE INVENTION

In a typical electrostatic reproducing machine, a photoconductive insulating surface, often in the form of a moving belt, is uniformly charged and exposed to a light image from an original document. The light image causes the exposed or background areas to become discharged, and creates an electrostatic latent image on the surface corresponding to the image contained within the original document. Alternatively, a light beam such as a laser beam may be modulated and used to selectively discharge portions of the photoconductive surface to record the desired information thereon. The electrostatic latent image is made visible by developing the image with a developer powder, referred to in the art as toner, which may be subsequently transferred to a support surface such as paper to which it may be permanently affixed by the application of heat and/or pressure.

In order to provide a return path and/or monitoring capability for charges induced in the photoreceptor, brush contacts are generally used. Conventional photoreceptor ground brushes include, for example, a stainless steel spring type ground brush having a bundle of stainless steel wires or spring clips made from beryllium copper spring stock or stainless steel. In typical electrostatic reproducing machines airborne non-conductive contaminants can be plentiful. These non-conductive contaminants can cause contact integrity problems with the aforementioned wire brushes and clips to the extent that electrical contact may be lost entirely. In order to overcome some of the contamination problems, excessively high normal forces must be applied to maintain contact. This may even require that backup plates be used to assure pressure points. Such high forces can exacerbate failures because the high forces cause premature wear of the electroconductive ground strip on the photoreceptor. In this respect the metallic clips and brushes cause excessive drag forces on the photoreceptor by adding to the forces that must be overcome by the drive system components. Another type of failure associated with conventional ground brushes is deformation of the belt timing hole, which is typically part of the ground strip. The metal wires and clips easily cause the edges of the hole to degrade to the point where their detection by an optical sensor is impaired, thereby causing a system failure. The ends or sides of the stainless wire strands typically make contact with the carbonaceous ground strip on the photoreceptor. Both the stainless steel spring and the bundle of wires fail to provide a dense area of contact by virtue of their design and construction. For example, the density of the contact is limited by how many wires can be bundled. In addition, excessively high normal forces must often be applied to these wire contacts in order to maintain contact with a sliding surface.

SUMMARY OF THE INVENTION

The presently existing ground return elements made of a conductive metal such as stainless steel are problematic. In view of these problems what is needed is a high density, low normal force contact surface for providing a continuous contact with a moving surface.

Accordingly, it is a primary object of the invention to provide an electroconductive member having high density contacts that do not create noise or sparking and having increased performance and reliability.

It is another object of the invention to provide an electroconductive member having a low normal force contact surface.

It is another object of the invention to provide a pultruded conductor having end fibers of a uniform length.

It is another object of the invention to provide a pultruded conductor that has minimal fiber shearing.

It is a further object of the invention to achieve easy alignment of a conductive element with respect to a contact location.

It is another object of the invention to provide a location for the accumulation of dust and debris that is generated during use of the conductive element in an electronic reprographic machine.

It is another object of the invention to provide a conductive element that is rigid in part while having one or more flexible ends for contacting one or more structures.

To realize these and other objects and to overcome the deficiencies set forth above with respect to conventional brush contacts, an electroconductive member is provided, comprising: a pultruded member having a hollow construction with a plurality of electroconductive strands embedded in a resin material. When cut to a desired length, the hollow pultruded member has exposed electroconductive strands on both faces of the cut ends. The strands at one or both ends are fibrillated and cut by using a laser. The hollow construction lends itself well to laser fibrillation thereby producing fibers having uniform lengths. In contrast, thicker pultrusions, although they can be cut by a laser, have shown to produce an uneven contact end. Upon contact of a fibrillated end of the pultruded member with a moving surface the uniform length electroconductive fibers conform to the surface, thereby eliminating breakage of shorter more rigid fibers that exist in an a thicker pultrusion having nonuniform fiber lengths. Additionally, during the pultrusion process an alignment structure may be formed integrally with the pultruded member. This alignment structure allows for accurate positioning of a fibrillated pultruded member in a holder or mount such that, for example, a fibrillated end is angled in proper orientation with respect to the direction of movement of a moving surface.

These and other objects, features and advantages of the invention will be apparent to those skilled in the art from the following detailed description of the invention, when read in conjunction with the accompanying drawings and claims.

BRIEF DESCRIPTION OF THE DRAWINGS

The invention will be described in detail with reference to the following drawings in which like reference numerals refer to like elements and wherein.

Figure 1:
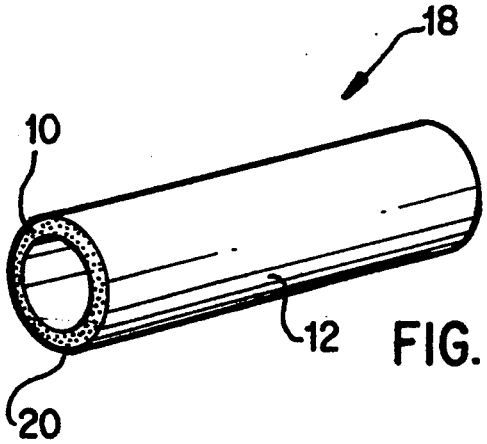
FIG. 1 is a perspective view of a portion of a hollow pultruded member.

In the drawings, various sizes and dimensions of the parts have been exaggerated or distorted for clarity of illustration or use in the description.

DETAILED DESCRIPTION OF PREFERRED EMBODIMENTS

In accordance with a preferred embodiment of the invention, a new class of electroconductive contacts is presented. The laser processed conductive carbon fiber pultrusions have a high density of electroconductive fibrous strands and a hollow configuration. Each electroconductive strand is embedded in a polymeric resin. Laser processing is used to strip the resin from the conductive strands on one or both ends of the pultrusion thereby exposing the electroconductive strands. Since the exposed electroconductive strands are of a uniform length, they achieve a uniform low stress contact and a maximum contact density with an opposing contact structure.

More specifically, in accordance with the present invention, an improved contact is provided that is of improved reliability and functionality, is of low cost, and is easily manufactured. These advantages are realized through the use of a manufacturing process, generally known as a pultrusion process, with the subsequent fibrillation of one or both ends of the pultruded member. Fibrillation involves the laser processing of a pultruded member to form a brush-like structure that provides a densely distributed filament contact.

For purposes of illustration the Figures depict a tubular geometric construction of a hollow pultruded member that is in no way intended to limit the scope of the invention. Any geometric configuration of the hollow pultruded member can be used. With reference now to FIG. 1, a hollow pultruded member 18 is formed by a pultrusion process and contains a plurality of fine diameter, high resistance electroconductive fiber strands 10 that are embedded in a resin material 12. Each electroconductive fiber strand 10 is continuous over the entire length of the hollow pultruded member. A cut hollow pultruded member 18 has a front face 20 that exposes, in cross-section, a high density of strands 10 embedded in resin material 12. Preferably, the resin material 12 is nonconductive and carbon fibers are the fibers of choice for strands 10 for a conductive connector in accordance with the invention.

Such carbon fiber based pultrusions are a subcategory of high performance conductive composite plastics, and comprise one or more types of continuous, conductive reinforcing filaments in a binder polymer. They provide a convenient way to handle, process and use fine diameter, carbon fibers without the problems typically encountered with free conductive fibers.

The pultrusion process generally consists of first pulling continuous lengths of fiber through a resin bath or impregnator, then into a preforming fixture where the resulting section is at least partially shaped and excess resin and/or air are removed. The section is then pulled into heated dyes where it is continuously cured. For a detailed discussion of pultrusion technology, reference is directed to "Handbook of Pultrusion Technology" by Raymond W. Meyer, first published in 1985 by Chapman and Hall, New York.

Figure 3:
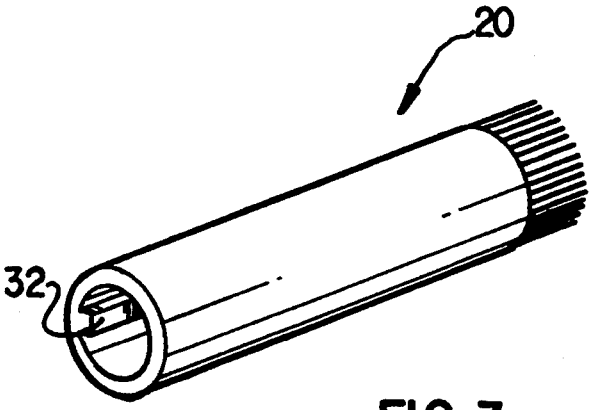
FIG. 3 is a perspective view of an embodiment of a thin walled electroconductive pultrusion that has a fibrillated end and an alignment structure.

More specifically, in the practice of the invention, conductive carbon fibers are submersed in a polymer bath and drawn through a die opening of suitable shape and elevated temperature to produce a hollow piece having dimensions and shapes controlled by the die. For example, as shown in an embodiment in FIG. 3, an alignment structure 32 is integrally formed with hollow pultruded member 18. Alignment structure 32 aligns a hollow pultruded member in a accurate position relative to a contact. For example, if the fibrillated end of hollow pultruded member 18 is angled for contact with a moving surface, when hollow pultruded member 18 is mounted, for example in a holder, alignment structure 32 is aligned with a complimentary alignment structure in the holder so that accurate positioning of pultruded member 18 is achieved. Examples of alignment structures include a notch and groove.

The structure that results from pultrusion has thousands of continuous length conductive fiber elements contained within the polymer matrix. The ends of the fiber elements are exposed to provide suitable electrical contacts. The very large contact redundancy achieved by the very large number of individual electroconductive fibers in a hollow pultruded member achieves substantial improvement and reliability of these devices. Hollow pultrusion member 18 can then be cut, shaped, or machined to achieve any desire structure.

Since the plurality of small diameter conductive fibers are pulled through the polymer bath and heated as a continuous length, the hollow tubular shaped member can be formed with the fibers being continuous from one end of the member to the other. Accordingly, the pultruded structure may be formed in a continuous length during the pultrusion process, then cut to any suitable dimension, with a very large number of filamentary electrical contacts exposed at each end and continuously connected therebetween. Such pultruded members may have either one or both of its ends subsequently fibrillated as described above. A part of the length of the pultruded member not fibrillated remains a substantially rigid composite of resin and electroconductive fiber strands.

The individual electroconductive fiber strands 10, can be made circular in cross-section having a diameter generally in the order from about 4 micrometers to about 50 micrometers and preferably from about 7 micrometers to 10 micrometers. This provides a very high degree of fibrous contact redundancy in a small cross-sectional area of the hollow pultruded member 18. Thus, used herein as contact materials, electroconductive fiber strands 10 provide a multiple redundancy of individual contact points, for example in the range between about $0.05\times10^5$ and $1\times10^5$ contacts/cm$^2$, any one, or more of which can serve as an effective contact. Moreover, the hollow construction of the pultruded member provides maximum fiber contact density for providing electroconductive contact because of the uniform fiber length achieved by laser fibrillation of the ends of the hollow pultruded member. Ultrahigh contact reliability is also achieved due to the availability of a very large number of fibrous contacts within a small contact zone, and by having substantially all the fibrous contacts contacting the contact structure due to their uniform length. Moreover, for instance, in electrostatic reproducing machines, such pultrusion based contacts are also likely to minimize the harmful effects of contamination within the machines due to their extraordinarily high contact density.

In accordance width a preferred embodiment of the invention, the electroconductive fiber strands 10 may be, rods or tubes having a diameter of about 4 micrometers having a roughly circular cross-sectional shape, as shown in the Figures. Electroconductive fiber strands 10 account for approximately 10–90% of the total cross sectional area of the pultruded composition. Typical fiber strands may be, for example, continuous strand carbon fiber or resistive carbon fiber. Electroconductive fiber strands 10 are carried in a suitable resin binder 12 to form hollow pultruded member 18. A particularly preferable class of fibers that may be used are those fibers that are obtained from controlled heat treatment processing to yield complete or perfect carbonization of polyacrylonitrile (PAN) precursor fibers. By carefully controlling the temperature of carbonization within certain limits, precise electrical resistivities for the carbonized carbon fibers may be obtained. The carbon fibers from PAN precursors are commercially produced by Stackpole Company, Celion Carbon Fibers Incorporated, division of BASF and others in yarn bundles of 1,000 to 160,000 filaments. The yarn bundles are carbonized in a two-stage process. The first stage involves stabilizing the PAN fibers at temperatures of the order of 300° C. in an oxygen atmosphere to produce preox-stabilized PAN fibers. The second stage involves carbonization of the fibers at elevated temperatures in an inert atmosphere, such as, for example, an atmosphere containing nitrogen. For further reference to the processes that may be employed in making these carbonized fibers, attention is directed to U.S. Pat. No. 4,761,709 to Ewing et al., the disclosure of which is incorporated by reference in its entirety herein, and the literature sources cited therein at column 8.

As mentioned, electroconductive fiber strands 10 are embedded in a suitable resin binder 12. Resin binder 12 should be of a material that will volatilize rapidly and cleanly upon direct exposure to a laser beam during laser processing described below. Thermal plastic polymers such as low molecular weight polyethylene, polypropylene, polystyrene, polyvinylchloride, nylon, polyester, polyimide, polyphenelyene sulfide, poly ether ether ketone (PEEK), polyimideamide, polyetherimide, and polyurethane may be particularly advantageously employed. Alternately, thermal setting polymers such as vinyl ester, polyester, and epoxy may also be employed in the practice of this invention.

A laser (not shown) can be used to cut individual components for use as an electrical contact in accordance with the invention. Preferably, the pultrusion is continuously rotated while the laser cuts the pultrusion to insure uniform fiber lengths. Thus, a suitably formed pultrusion can be cut by laser techniques to form a contact of desired length from the longer pultrusion length (FIG. 1), and at the same time, one or both severed ends are fibrillated (FIG. 2) to provide a high redundancy fiber contact member that has fiber strands of a uniform length. By having both high redundancy fiber contact and uniform fiber strand lengths, achievable with the hollow pultruded construction. Contact face 14 has a maximum high redundancy contact face: for contact with, for example, a moving surface. Any suitable laser can be used so that the resin binder 12 will volatilize appropriately thereby fibrillating, or partially fibrillating the electrical contact element. Examples of specific lasers which may be used include a carbon dioxide laser, a YAG laser, or an argon ion laser. The carbon dioxide laser is particularly suited for this application, and is economical in large scale manufacturing. Additionally, other mechanical resin removal techniques (for example water jets) which yield a similar structure may also be used as long as a fiber rich surface structure is maintained.

In accordance with the invention, the single beam laser cutting process performed on hollow tubular pultruded member 18 optimally produces a fibrillated member with uniform fiber lengths when the difference between an exterior diameter and an interior diameter of pultruded member 18 is held to 1 millimeter or less. When hollow pultruded member 18 can be cut at any angle at one or both of the ends of the member 18, as long as the cut is a planar. Because the laser can cut across any plane of member 18, the contact face 14 for contacting a sliding contact has fiber strands of a uniform length. For example, a conical, continually tapered end configuration can be obtained by appropriately orienting a laser at an angle to the pultrusion to be cut and achieve a uniform fiber length by contacting the contact at the appropriate angle. It is within the scope of the invention to laser cut a contact face of nonuniform fiber strand length to achieve high redundancy fiber contact with a uniquely configured contact. For example, an end can be laser cut in a stepwise configuration. The alignment structure on the pultrusion is particularly advantageous when a pultruded member has a specific laser cut contact face so that an accurate alignment of the contact face with the contact is achieved.

Figure 2:
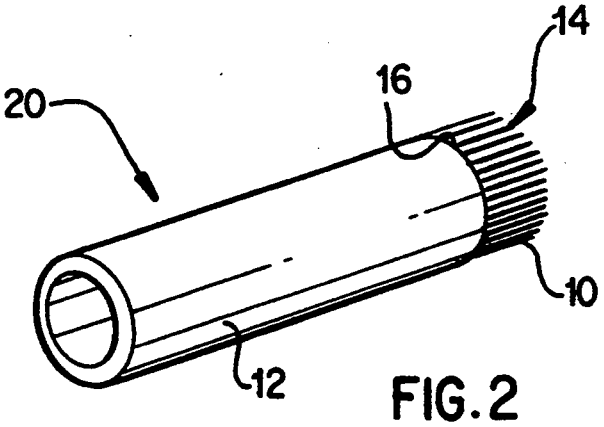
FIG. 2 is a perspective view of a portion of a hollow pultruded member having a fibrillated end.

FIG. 2 shows, a fibrillated hollow tubular pultruded member 22, fibrillated by laser techniques. For example, a focused $CO_2$ laser can be used to cut hollow tubular pultruded member 18 (FIG. 1) and simultaneously volatilize resin binder 12 in a controlled manner a sufficient distance 16 from a contact end 14 of electroconductive fiber strands 10 to produce in one step a distributed filament contact with electroconductive fiber strands 10 of a uniform length. The length of exposed carbon fiber strands can be controlled by the laser power and cut rate. In addition, a heat sink can be used to control the length of exposed carbon fiber strands.

Figure 5:
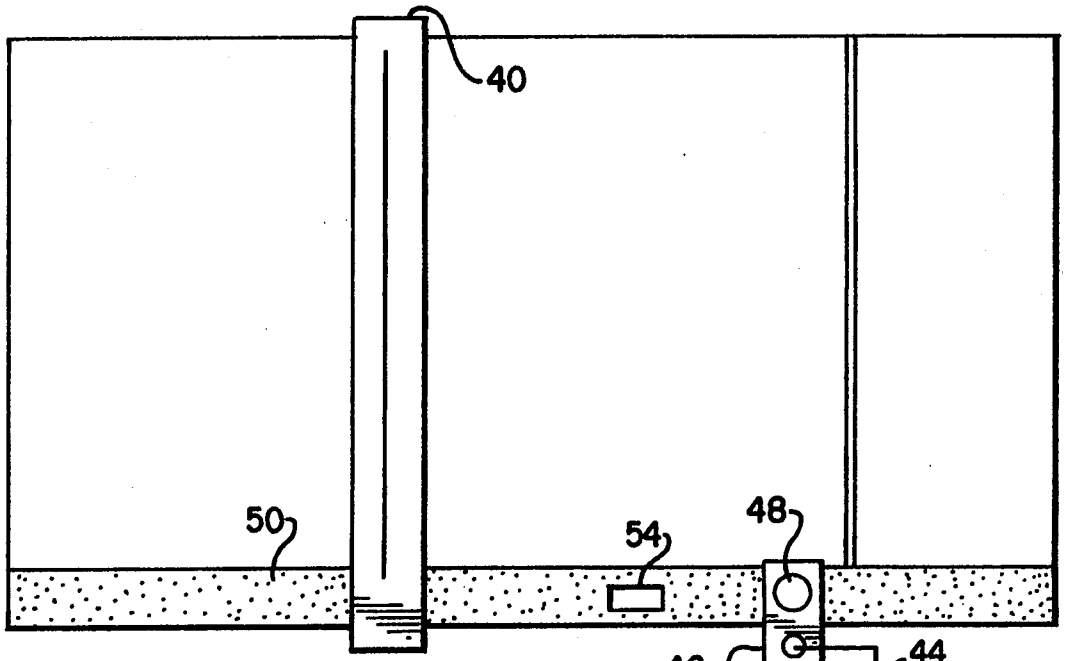
FIG. 5 is a top view of a photoreceptor belt in conductive connection with a photoreceptor ground brush.
Figure 4:
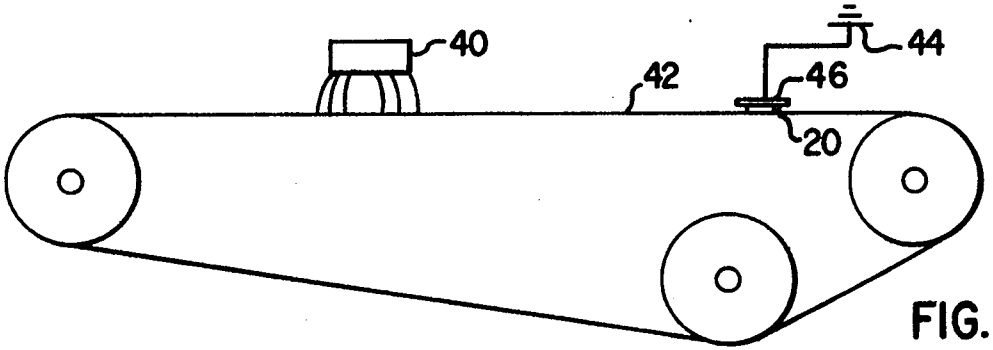
FIG. 4 is a side view of a photoreceptor belt in conductive connection with a photoreceptor ground brush.

FIG. 4 illustrates one embodiment in accordance with the invention for use of fibrillated hollow pultruded member 20 in an electrostatic reproducing machine. Fibrillated hollow pultruded member 20 acts as a ground brush contact. FIGS. 4 and 5 show an embodiment having a photoreceptive belt 42 that receives a uniform charge from a charge device 40 for processing an image. A conductive ground strip 50 on photoreceptive belt 42 stores the charges built up on moving belt 42 during processing of an image. A timing hole 54 extends through ground strip 50 on photoreceptive belt 42. Conductive ground strip 50 is in conductive contact with a fibrillated end of fibrillated pultruded member 20. Fibrillated pultruded member 20 acts as a conductive ground contact brush to discharge conductive ground strip 50. A spring clip 46 provided with mount 52 for holding the fibrillated pultruded member 20 in firm conductive contact to a ground 44 on a frame member of the machine.

Figure 7:
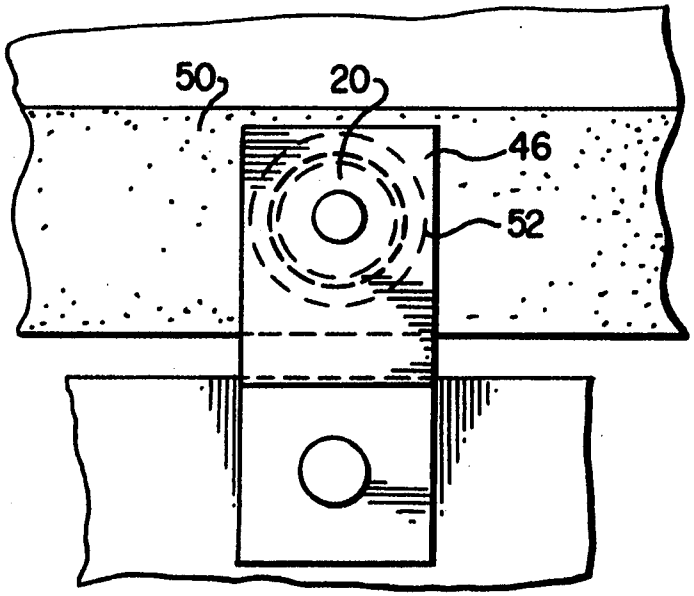
FIG. 7 is a top view of the ground brush in conductive connection with a grounded machine frame member and a conductive ground strip of the photoreceptor belt.
Figure 6:
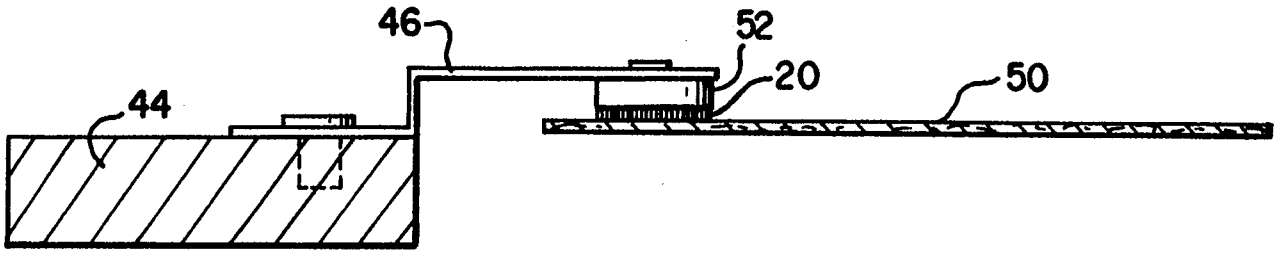
FIG. 6 is a side view of the ground brush in conductive connection with a grounded machine frame member and a conductive ground strip of the photoreceptor belt.

FIGS. 6 and 7 illustrate an embodiment in which the mount 46 is a spring clip. Spring clip 46 holds fibrillated member 20 forcibly in contact with conductive ground strip 50. In addition, spring clip 46 is conductively connected with ground 44 on a frame member of the machine. FIG. 7 shows a top view of spring clip 46 with fibrillated pultruded member 20 mounted thereon. Ground strip 50 is discharged through fibrillated pultruded member 22 and spring clip 46 to machine frame member 44.

The fibrillated hollow pultruded member 22 can be made to have a relatively long length,, for example on the order of up to about one foot, or more. The part of the pultruded member that is not fibrillated remains as a long rigid structure composed of continuous conductive fiber strands 10 embedded in resin material 12. The fiber strands embedded in the resin material are sufficiently rigid, therefore, support is only necessary at one end of fibrillated pultruded member 22 to rigidly locate the conductive connector between the moving photoreceptive belt and the ground terminal.

In another embodiment, the invention can be used as a biasing element, for example, for applying a voltage to a moving surface.

In another embodiment, the invention provides a high resistance, high voltage contact. This contact may be used in many applications, examples of which are as a high voltage input contact for an electrostatic voltmeter, useful, for instance, to continuously measure the electrostatic charge on a moving photoreceptive surface (not shown). Another example in which the contact may be used is a connector for a high voltage corotron. If desired, the high resistance of the fiber can serve as a load resistor for the circuit, thereby providing, for example, the combination of a ballast resistor and a high voltage connector in conjunction with an external circuit to which the contact establishes electrical connection.

The hollow construction pultruded member is an advantageous construction for forming a conductive connector. One advantage is a laser lends itself well to cutting a hollow pultruded member because the small difference between the inner and outer diameters of the hollow member. When the difference in the, diameters of a pultruded member increases beyond about 1 mm, fibers are cut at an uneven lengths and the resin is burned unevenly along the pultrusion member. Another advantage of the hollow construction is that debris and particles can build up in the interior of the hollow member. This is particularly advantageous in reprographic machines where toner is used on the photoreceptive belt. A further advantage of the hollow construction is that the alignment structure can be formed on an interior surface thereby maintaining a smooth outer surface.

Although the invention has been described and illustrated with a certain degree of particularity, it is understood that the present disclosure has been made only by way of example, and that numerous changes and the combination and arrangement of parts can be resorted to by those skilled in the art without departing from the spirit and scope of the invention, as hereinafter claimed.

What is claimed is:

1. A conductive contact, comprising:

a pultruded member of hollow construction, having a first and a second end, comprising:

a plurality of conductive strands; and a resin material in which said plurality of conductive strands are embedded; and said pultruded member having exposed conductive strands on at least one of said first and said second ends.

2. The conductive contact of claim 1, wherein at least one of said first and second ends of said pultruded member are laser fibrillated.

3. The conductive contact of claim 2, wherein said at least one of said laser fibrillated first and second ends are of a predetermined uniform length.

4. The conductive contact of claim 1, wherein said conductive contact provides electrical connection between a photosensitive recording medium and a ground.

5. The electroconductive contact of claim 4, wherein at least one of said first and second ends of said pultruded member is fibrillated, said fibrillated end contacting said photosensitive recording medium.

6. The conductive contact of claim 5, wherein said photosensitive recording medium comprises a ground strip, said fibrillated end of said pultruded member contacts said ground strip.

7. The conductive contact of claim 1, wherein said pultruded member of hollow construction has an inner and an outer surface, at least one of said inner and said outer surfaces comprising an alignment structure thereon.

8. The conductive contact of claim 7, wherein said alignment structure comprises one of a notch and a groove.

9. The conductive contact of claim 7, wherein said alignment structure extends along a length of said pultruded member.

10. The conductive contact of claim 8, wherein said alignment structure is in alignment with a complimentary structure of a mount for mounting the alignment structure thereby aligning said pultruded member for contact in a predetermined orientation.

11. The conductive contact of claim 7, wherein said pultruded member is disposed in a mount, said alignment structure positioning said pultruded member in said mount for contact.

12. The conductive contact of claim 1, wherein said hollow construction has a circular cross-sectional shape.

13. The conductive contact of claim 1, wherein said hollow construction has a rectangular cross sectional shape.

14. The conductive contact of claim 1, wherein said hollow pultruded member has an inner and an outer diameter, a difference between said inner and outer diameter being substantially one millimeter or less.

15. The conductive contact of claim 1, wherein said resin material is nonconductive.

16. The conductive contact of claim 1, wherein said plurality of conductive strands comprise between 10% and 90% of a cross-sectional area of the pultruded member.

17. The conductive contact of claim 1, wherein said hollow pultruded member is adapted for receiving and storing particulate contaminants.

18. The conductive contact of claim 1, wherein said conductive strands are continuous from said first end of said pultruded member to said second end of said pultruded member.

19. The conductive contact of claim 1, wherein said resin material of said pultruded member provides a rigid structure.

20. The conductive contact of claim 1, wherein said first and second ends of said pultruded member are laser fibrillated.

21. The conductive contact of claim 1, wherein said resin material is selected from one of the group consisting of: polyethylene, polypropylene, polystyrene, polyvinylchloride, nylon, polyester, polyimide, polyphenelyene sulfide, poly ether ether ketone, polyimideamide, polyetherimide, and polyurethane, vinyl ester and polyester.

22. An electrostatic reproducing machine for reproducing an image of an original document onto a support surface, comprising:

a main frame having a ground terminal and a photosensitive recording medium;

a conductive contact connecting said ground terminal and said photosensitive recording medium, said conductive connector comprising:

a pultruded member having a hollow construction, a first end and a second end, comprising:

a plurality of conductive strands; and a resin material in which said plurality of conductive strands are embedded; and said pultruded member having exposed conductive strands on at least one of said first and second ends.

23. The electrostatic reproducing machine of claim 2, wherein at least one of said first and second ends of said pultruded member are laser fibrillated.

24. The electrostatic reproducing machine of claim 23, wherein said at least one of said laser fibrillated first and second ends are of a predetermined uniform length.

25. The electrostatic reproducing machine of claim 22, further comprising a photosensitive recording medium and a ground, said conductive contact providing a conductive connection between said photosensitive recording medium and said ground.

26. The electrostatic reproducing machine of claim 25, wherein at least one of said first and second ends of said pultruded member is fibrillated, said fibrillated end contacting said photosensitive recording medium.

27. The electrostatic reproducing machine of claim 26, wherein said photosensitive recording medium comprises a ground strip, said fibrillated end of said pultruded member contacting said ground strip.

28. The electrostatic reproducing machine of claim 22, wherein said pultruded member of hollow construction has an inner and an outer surface, at least one of said inner and said outer surfaces having an alignment structure disposed thereon.

29. The electrostatic reproducing machine of claim 28, wherein said alignment structure comprises one of a notch and a groove.

30. The electrostatic reproducing machine of claim 28, wherein said alignment structure is in alignment with a complimentary structure of a mount for mounting the alignment structure thereby aligning said pultruded member for contact in a predetermined orientation.

31. The electrostatic reproducing machine of claim 28, wherein said pultruded member is disposed in a mount, said alignment structure positioning said pultruded member in said mount for contact.

32. The electrostatic reproducing machine of claim 28, wherein said alignment structure extends along a length of said pultruded member.

33. The electrostatic reproducing machine of claim 22, wherein said hollow pultruded member has an inner and an outer diameter, a difference between said inner and outer diameter being substantially one millimeter or less.

34. The electrostatic reproducing machine of claim 22, wherein said resin material is nonconductive.

35. The electrostatic reproducing machine of claim 22, wherein said hollow construction has a circular cross-sectional shape.

36. The electrostatic reproducing machine of claim 22, wherein said hollow construction has a rectangular cross-sectional shape.

37. The electrostatic reproducing machine of claim 22, wherein said conductive strands are continuous from said first end of said pultruded member to said second end of said pultruded member.

38. The electrostatic reproducing machine of claim 22, wherein said resin material of said pultruded member provides a rigid structure.

39. The electrostatic reproducing machine of claim 22, wherein said first and second ends of said pultruded member are laser fibrillated.

40. The electrostatic reproducing machine of claim 22, wherein said resin material is selected from one of the group consisting of: polyethylene, polypropylene, polystyrene, polyvinylchloride, nylon, polyester, polyimide, polyphenelyene sulfide, poly ether ether ketone, polyimideamide, polyetherimide, and polyurethane, vinyl ester and polyester.

41. The electrostatic reproducing machine of claim 22, wherein said hollow pultruded member is adapted for receiving and storing particulate contaminants.

* * * * *